US008668294B2

(12) United States Patent
Mantell et al.

(10) Patent No.: US 8,668,294 B2
(45) Date of Patent: Mar. 11, 2014

(54) METHOD AND SYSTEM FOR SPLIT HEAD DROP SIZE PRINTING

(75) Inventors: David Mantell, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 202 days.

(21) Appl. No.: 13/329,892

(22) Filed: Dec. 19, 2011

(65) Prior Publication Data

US 2013/0155137 A1 Jun. 20, 2013

(51) Int. Cl.

| | |
|---|---|
| ***B41J 29/38*** | (2006.01) |
| ***B41J 2/205*** | (2006.01) |
| ***B41J 2/15*** | (2006.01) |

(52) U.S. Cl.
USPC ..... 347/9; 347/14; 347/15; 347/40

(58) Field of Classification Search
USPC ..... 347/5, 14–16, 9, 40
See application file for complete search history.

(56) References Cited

U.S. PATENT DOCUMENTS

| | | | | |
|---|---|---|---|---|
| 4,746,935 | A | 5/1988 | Allen | |
| 5,745,131 | A | 4/1998 | Kneezel et al. | |
| 6,030,065 | A | 2/2000 | Fukuhata | |
| 6,149,260 | A | 11/2000 | Minakuti | |
| 6,402,280 | B2 | 6/2002 | Kneezel et al. | |
| 6,406,115 | B2 | 6/2002 | Mantell et al. | |
| 6,464,330 | B1 | 10/2002 | Miller et al. | |
| 6,565,191 | B1 * | 5/2003 | Bolash et al. | 347/40 |
| 6,705,699 | B2 | 3/2004 | Du et al. | |
| 7,309,117 | B1 * | 12/2007 | Walton et al. | 347/15 |
| 7,575,293 | B2 | 8/2009 | Snyder et al. | |
| 7,588,305 | B2 * | 9/2009 | Knierim et al. | 347/14 |
| 8,491,075 | B2 * | 7/2013 | Zhou et al. | 347/10 |
| 2005/0099439 | A1 * | 5/2005 | Folkins | 347/8 |
| 2009/0141074 | A1 * | 6/2009 | Kubo et al. | 347/30 |
| 2009/0262370 | A1 | 10/2009 | Mantell et al. | |

* cited by examiner

*Primary Examiner* — Sarah Al Hashimi
(74) *Attorney, Agent, or Firm* — Maginot, Moore & Beck, LLP

(57) ABSTRACT

A method for operating an inkjet printer to form images that include both high density and low density segments has been developed. The method includes operating one printhead to eject ink drops with a large size to form high density segments of the image, and operating a second printhead to eject ink drops with a small size to form low density segments of the image. The large ink drops provide high coverage in the high density segments, and the small ink drops provide improved image quality in the low density segments of the image.

21 Claims, 7 Drawing Sheets

METHOD AND SYSTEM FOR SPLIT HEAD DROP SIZE PRINTING

TECHNICAL FIELD

This disclosure relates to imaging devices that generate printed images on an image receiving member with ink drops, and more particularly, to imaging devices that form images with ink drops of different sizes.

BACKGROUND

Imaging devices form images on image receiving members that include paper and other print media. Different imaging or printing techniques, which include laser printing, inkjet printing, offset printing, dye-sublimation printing, thermal printing, and the like, may be used to produce printed documents. In particular, inkjet imaging devices eject liquid ink from printheads to form images on an image receiving member. The printheads include a plurality of inkjets that are arranged in some type of array. Each inkjet has a thermal, piezoelectric, or mechanical actuator that is coupled to a printhead controller. The printhead controller generates firing signals that correspond to digital data for images. The printhead actuators respond to the firing signals by ejecting ink drops onto an image receiving member to form an ink image that corresponds to the digital image used to generate the firing signals. The size of the ink drops and the timing of the ejection of the ink drops are affected by the frequency, wave shape, and amplitude of the firing signals.

In an inkjet printer, the digital image data often specify different areas of an image that receive different amounts of ink during the imaging process. A "halftone percentage" describes the coverage of ink over an area of the image receiving member. For example, a 100% halftone refers to a high coverage area of the image that is fully covered in ink, such as a solid region of a picture or to dark text letters printed on the image receiving member. A low coverage halftone area refers to areas of the image where the ink covers less than fifty percent of an area, while the remainder of the area is the bare image receiving member. For example, in a 25% halftone area, the printer covers 25% of a given area of the image receiving member with ink drops and the remaining 75% of the area is bare. In a common configuration where ink images are formed on white paper, the drops in the halftoned area are spaced apart in a "dithered" pattern so that the human eye perceives light reflected from the ink drops and the paper as a uniform color that is lighter than a 100% coverage area. For example, a 100% black coverage area appears as a solid black color, while a 25% halftoned area using black ink appears as a shade of gray. The printer forms images with a wide range of halftones to form ink images, and multi-color printers can print different colors of inks in various halftone patterns to form images with a wide range of perceived colors.

Existing inkjet printers face challenges when printing images that include high coverage, high ink density areas and low coverage, low ink density areas in a single printed page. Specifically, larger ink drops are used in the high coverage areas of the printed images to provide a uniform coating of ink over the high coverage areas of the image receiving member. However, use of larger ink drops for low to moderate ink densities produces images with objectionable "graininess," meaning the individual drops are more visible to the human eye. In low coverage areas, smaller ink drops are ejected to produce more uniform colors with a reduced "graininess" where the human eye perceives a blended color of the ink and underlying paper instead of the individual ink drops. While some existing printhead designs can be selectively configured to print either large ink drops or small ink drops on a drop by drop basis, such is not the case with all printhead designs. In many printhead designs that enable dynamic changing of the ink drop size, printing is more costly than printing with non-dynamic drop changing designs, which enable only a single ink drop size at a time. The additional expense arises from the time consumed in reconfiguring the printhead between a large ink drop mode and small ink drop mode and the inability of the printheads to change the mode of operation on an inkjet by inkjet basis within a printhead. In one known reconfiguration method, an image receiving member is moved past a printhead two or more times and the printhead prints ink drops of a selected size during each pass of the image receiving member. While this technique enables printing with different sizes of ink drops in a single image, the time required for multiple passes with the printhead over the image receiving member lowers the throughput of the printer. Consequently, improvements to inkjet printers that enable non-dynamic printhead designs to eject multiple ink drop sizes in an efficient manner would be beneficial.

SUMMARY

A method optimizes the image quality and graininess of a printed image produced by a single-pass inkjet printing system by selectively ejecting ink drops of specified sizes to correlate with particular image densities throughout the printed image. The method includes receiving image data for a color separation, storing a portion of the color separation image data in a first memory map used to generate electrical signals for operating at least one printhead that is configured to eject ink drops of a first color and first ink drop mass, storing a remaining portion of the color separation image data in a second memory map used to generate electrical signals for operating at least one other printhead that is configured to eject ink drops of the first color and second ink drop mass, the second ink drop mass being greater than the first ink drop mass, generating a first plurality of electrical signals for operating the at least one printhead with reference to the first memory map for the at least one printhead, and generating a second plurality of electrical signals for operating the at least one other printhead with reference to the second memory map for the at least one other printhead.

To implement the method for optimizing the image quality and graininess of a printed image, an inkjet printer has been developed. The printer includes a first printhead positioned in a print zone including a first plurality of inkjets, the first printhead being configured to eject ink drops of a first color and first ink drop mass, a second printhead positioned in the print zone including a second plurality of inkjets, the second printhead being configured to eject ink drops of the first color and a second ink drop mass, the second ink drop mass being greater than the first ink drop mass, a media path configured to move a print medium through the print zone in a process direction past the first printhead and the second printhead, and a controller operatively connected to the first printhead, the second printhead, and the media path, the controller being configured to: receive image data for a color separation, store a portion of the color separation image data in a first memory map used to generate electrical signals for operating the first printhead, store a remaining portion of the color separation image data in a second memory map used to generate electrical signals for operating the second printhead, generate a first plurality of electrical signals for operating the first printhead with reference to the first memory map for the first printhead, and generate a second plurality of electrical signals for operating the second printhead with reference to the second memory map for the second printhead.

BRIEF DESCRIPTION OF THE DRAWINGS

The foregoing aspects and other features of a system and method for printing ink drops of different sizes from selected printheads in a printer are explained in the following description, taken in connection with the accompanying drawings.

DETAILED DESCRIPTION

Figure 1:
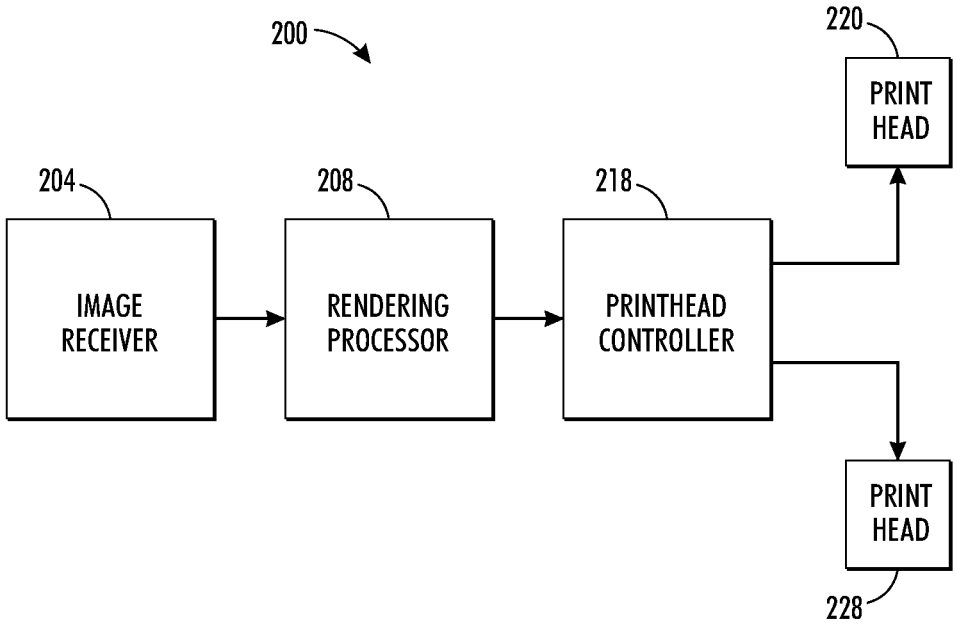
FIG. 1 is a block diagram of a system that processes input image values in a color separation to eject ink of different sizes from selected printheads in a printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that forms a printed image on media. Examples of printers include, but are not limited to, digital copiers, bookmaking machines, facsimile machines, multi-function machines, or the like. The term "image receiving member" encompasses any print medium including paper, as well as indirect imaging members, such as imaging drums or belts. As used herein, the term "process direction" refers to a direction of travel of the image receiving member in the printer, and the term "cross-process direction" refers to a direction that is perpendicular to the process direction on the surface of the image receiving member. The terms "image" and "printed image" refer to any pattern of ink drops that a printer forms on the image receiving member. Examples of images include text and graphics in one or more colors that are printed on the image receiving member.

Figure 3:
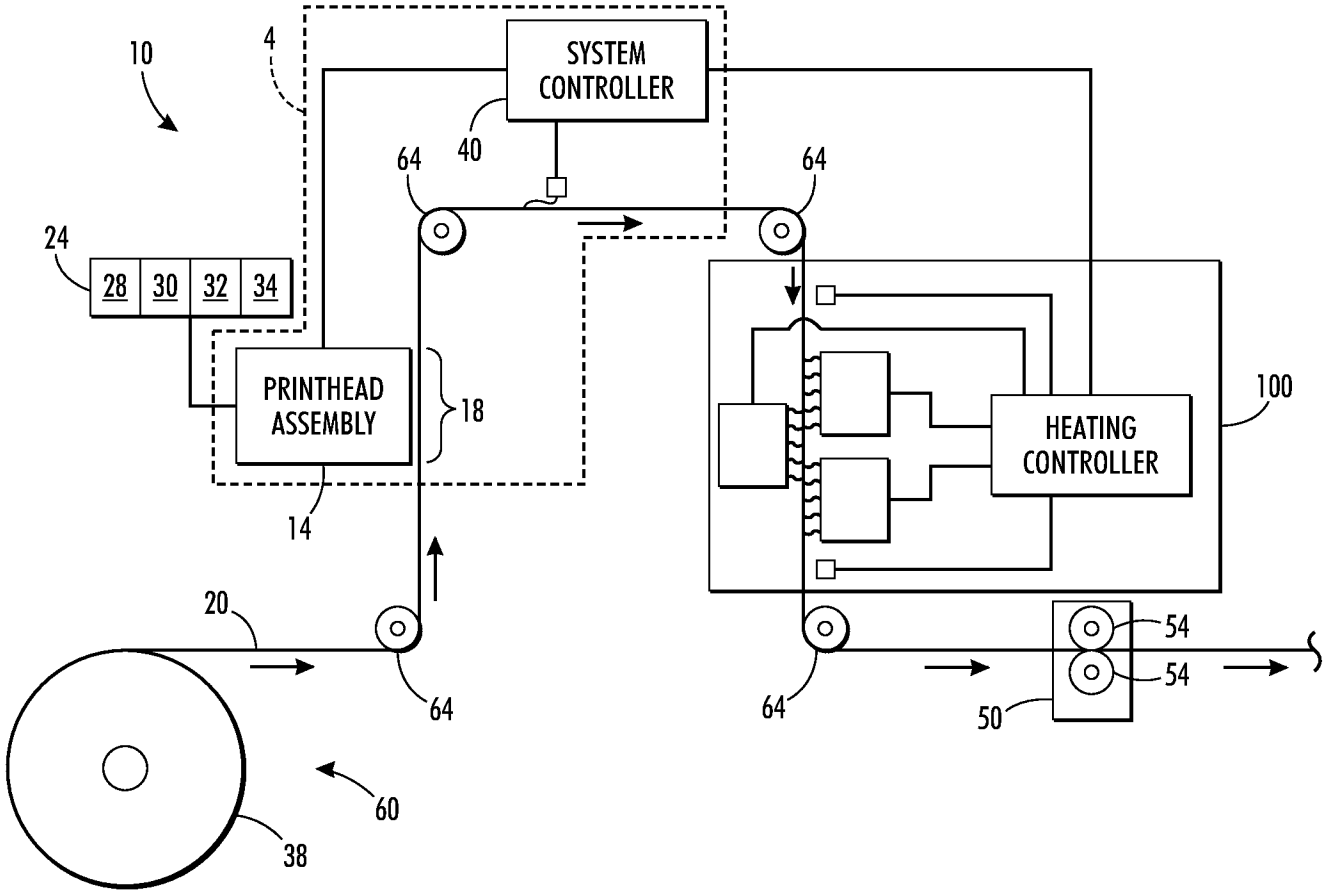
FIG. 3 is a block diagram of a prior art inkjet printing system in which a system and method for printing ink drops of different sizes from selected printheads in a printer may be used.

FIG. 3 depicts a prior art inkjet printer 10 having elements pertinent to the present disclosure. In the embodiment shown, the printer 10 implements a solid ink print process for printing onto a continuous media web. Although the image density driven ink drop ejection method and apparatus are described below with reference to the printer 10 depicted in FIG. 3, the subject method and apparatus disclosed herein may be used in any printer, such as a cartridge inkjet printer, which uses serially arranged printheads to eject ink onto an image substrate.

The printer 10 includes a web supply and handling system 60, a printhead assembly 14, a web heating system 100, and a fixing assembly 50. The web supply and handling system 60 includes one media supply roll 38 for supplying a media web 20 to the printer 10. The supply and handling system 60 is configured to feed the media web 20 in a known manner along a media pathway in the printer 10 through a print zone 18 located adjacent to the printhead assembly 14, past the web heating system 100, and through the fixing assembly 50. To this end, the supply and handling system 60 includes any suitable device 64, such as drive rollers, idler rollers, tensioning bars, etc., for moving the media web 20 through the printer 10. The printer 10 may include a take-up roll (not shown) for receiving the media web 20 after printing operations have been performed. Alternatively, the media web 20 may be fed to a cutting device (not shown) as is known in the art for cutting the media web into discrete sheets. The printhead assembly 14 is appropriately supported to eject drops of ink directly onto the media web 20 as the web moves through the print zone 18. In other printers in which the image density driven ink drop ejection method and apparatus may be used, the printhead assembly 14 may be configured to eject drops onto an intermediate transfer member (not shown), such as a rotating drum or belt, for subsequent transfer to a media web or media sheets.

Figure 4:
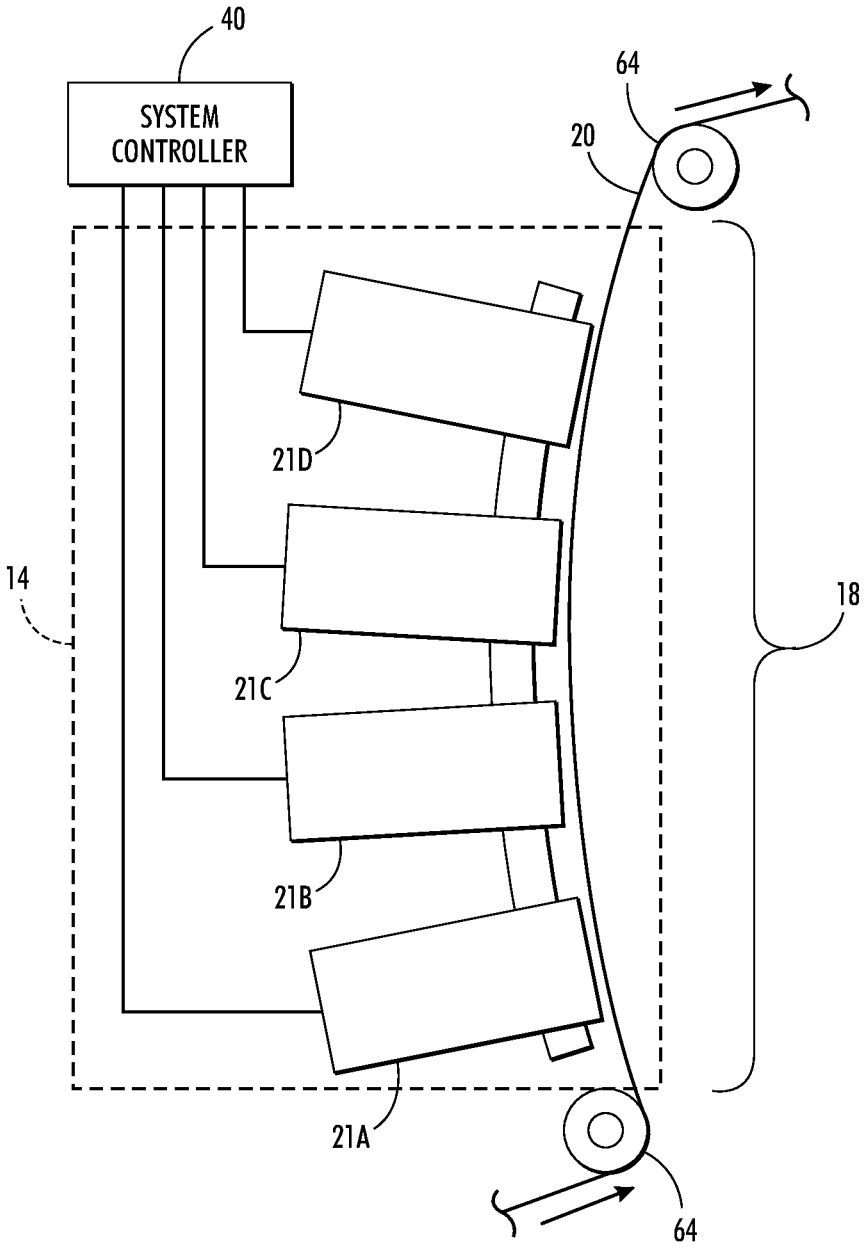
FIG. 4 is an enlarged view of a printhead assembly included within the inkjet printing system with the enlarged view showing an arrangement of a series of printhead modules used to eject ink of different colors.

Referring to FIG. 4, the printhead assembly 14 includes a series of printhead modules 21A, 21B, 21C, and 21D with each printhead module effectively extending across the width of the media web 20. As is generally familiar, each of the printhead modules 21A, 21B, 21C, and 21D may eject a single color of ink, one for each of the colors typically used in color printing; namely, the primary colors cyan, magenta, yellow, and black (CMYK). The printhead module for each primary color may include two or more serially arranged printheads with the multiple printheads formed into a multiple row array. Although the embodiment shown discloses a series of printhead modules, a printer may include as few as one printhead module for printing images using only one color, such as black. In many implementations of the printhead assembly, a plurality of inkjets is arranged in a row and column fashion on each printhead. Each of the inkjets is coupled to a source of liquid ink and each one ejects ink through an inkjet nozzle in response to a firing signal being received by an inkjet actuator, such as a piezoelectric actuator, in the inkjet.

Referring again to FIG. 3, the printer 10 uses "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the printer may comprise UV curable gel ink. Gel ink is heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Ink is supplied to the printhead assembly from a solid ink supply 24. In aqueous or emulsion ink systems, which use the ink drop ejection method and apparatus disclosed herein, the liquid ink is stored in one or more volumetric containers installed in the printer. Since the printer 10 is a multicolor device, the ink supply 24 includes four sources of solid phase change ink, including a cyan source 28, a yellow source 30, a magenta source 32, and a black source 34. The imaging device 10 also includes a solid phase change ink melting and control assembly or apparatus (not shown) for melting or phase changing the solid form of the phase change ink into a liquid form, and then supplying the liquid ink to the printhead assembly 14. Each color of ink is supplied to one of the series of printhead modules 21A, 21B, 21C, and 21D within the printhead assembly 14. The differently colored inks are supplied through separate conduits. A single line connects the ink supply 24 with the printhead assembly 14 in FIG. 3 to simplify the representation depicted in the figure.

Referring still to FIG. 3, operation and control of the various subsystems, components, and functions of the printer 10 are performed with the aid of a controller 40. The controller 40 can be implemented with general or specialized programmable processors that execute programmed instructions. The instructions and data required to perform the programmed functions can be stored in memory associated with the processors or controllers. The processors, their memories, and interface circuitry configure the controllers and/or print engine to perform the printer functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In order to form an image with the ink ejected by the printhead assembly 14, image data received by the printer 10 are converted into firing signals that selectively actuate the inkjets in the printheads to eject ink onto the web 20 as it moves past the printhead assembly 14. The controller 40 receives velocity data from encoders mounted proximately to rollers positioned on either side of the portion of the path opposite the four printhead modules 21A, 21B, 21C, and 21D to compute the position of the web 20 as it moves past the printhead modules 21A, 21B, 21C, and 21D. The controller 40 uses these velocity data to generate timing signals delivered to printhead controllers in the printhead modules that enable the printhead controllers to generate firing signals that actuate selected inkjet ejectors in the printheads. The inkjet ejectors actuated by the firing signals correspond to image data processed by the controller 40.

The processor for the print engine can be one or more processors configured to perform the color separation processing described below. The processor can be a general purpose processor having an associated memory in which programmed instructions are stored. Execution of the programmed instructions enables the processor to process the image data for a color separation and map each ink density in a color separation to a printhead ejecting ink drops of a corresponding mass for a particular color. The processorcan, alternatively, be an application specific integrated circuit or a group of electronic components configured on a printed circuit that process the image data serially arranged printheads ejecting ink of a particular color. Thus, the processor can be implemented in hardware alone, software alone, or a combination of hardware and software. In one embodiment, the processor for the print engine that renders each portion of a color separation comprises a self-contained, microcomputer having a central processor unit (not shown) and electronic storage (not shown). The electronic storage can be a non-volatile memory, such as a read only memory (ROM) or a programmable non-volatile memory, such as an EEPROM or flash memory. The image data source can be any one of a number of different sources, such as a scanner, a digital copier, a facsimile device, etc. Once the controller 40 has used the input values to generate timing signals for the printhead controllers that operate the inkjets in the serially arranged printheads, the printhead assembly 14 ejects drops of ink onto the moving web 20, forming an image within the print zone 18.

Figure 5:
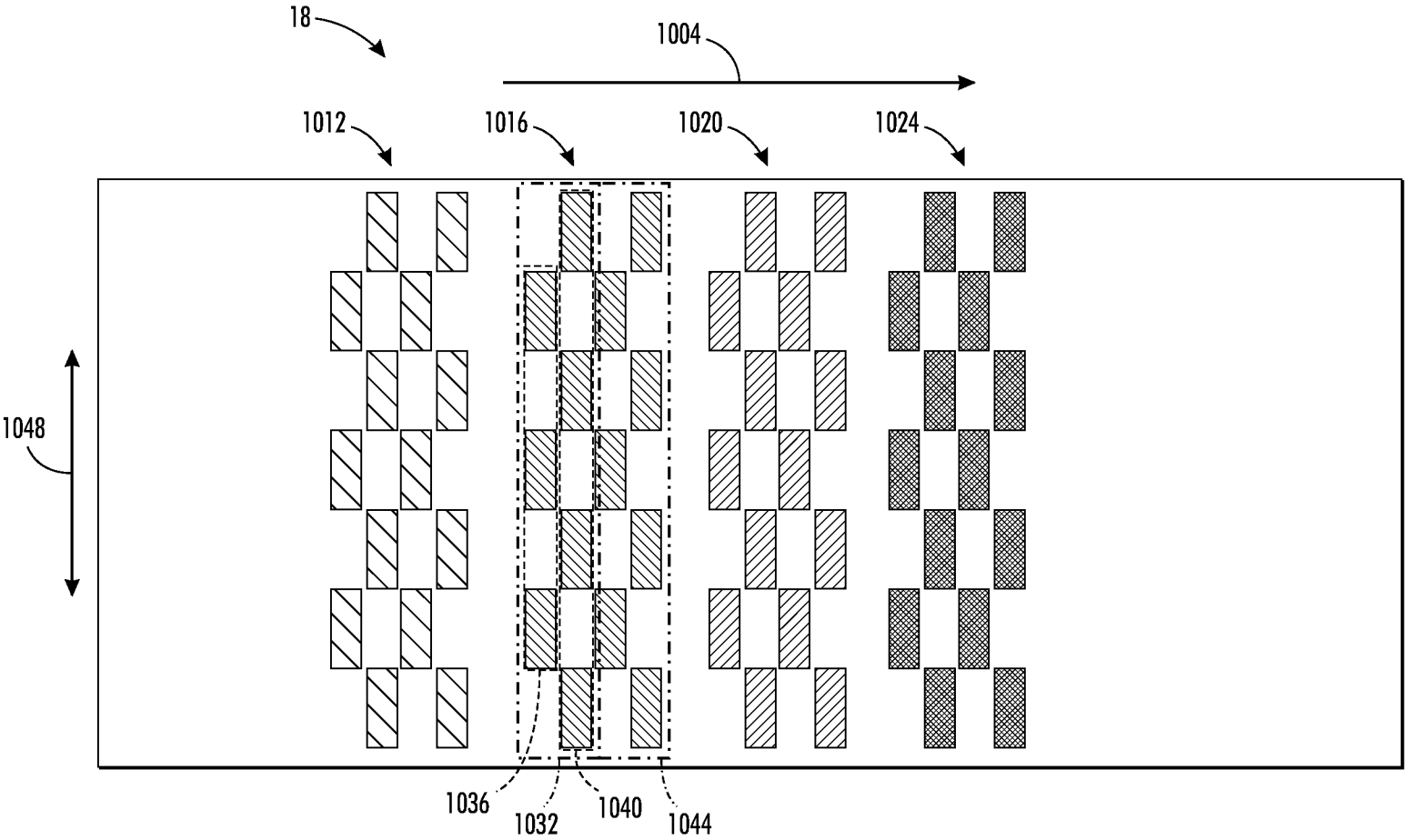
FIG. 5 PRIOR ART
FIG. 5 is a schematic of a print zone of an inkjet printing system utilizing full color, serially arranged printheads.

Referring to FIG. 5, a schematic view of the print zone 18 is generally shown. The print zone 18 is formed by the printhead modules 21A, 21B, 21C, and 21D. As noted above, each of these modules ejects ink of a different color onto an image receiving member passing through the print zone. The ink ejected from the printhead modules 21A, 21B, 21C, and 21D, respectively, defines color units 1012, 1016, 1020, 1024 for each color of ink. The process direction 1004 is the direction that an image receiving member moves as it travels under each module. Each module includes at least two print arrays. As shown in FIG. 5, each print array includes two print bars with each print bar carrying multiple printheads. For example, a printhead array 1032 of the color unit 1016 includes two print bars 1036 and 1040. Each print bar carries a plurality of printheads, as exemplified by the three printheads on print bar 1036 and the four printheads on the print bar 1040. Alternative configurations of print bars may employ a greater or lesser number of printheads.

Each printhead is configured to eject ink drops of a predetermined inkjet spacing in the cross-process direction, which may be, for example, 300 dots per inch (dpi). The printhead configuration refers to the spacing between apertures in the printhead face for adjacent inkjets in the cross-process direction. Thus, this spacing is a parameter of the manufacture of the printhead. This inkjet spacing defines a first resolution in a cross process direction 1048. The printheads on the print bars within a print array, such as the printheads on the print bars 1036 and 1040 within print array 1032, are staggered. By timing the firing of the inkjets in the printheads on bar 1036 and bar 1040 a line is printed across the image receiving member in the cross process direction 1048 at the spacing or resolution of the printheads on the two bars. The two or more print arrays for a particular color, such as print arrays 1032 and 1044, are serially arranged, meaning that some of the printheads are located downstream in the direction of web movement from the other printheads that eject the same color of ink. The downstream printheads, such as the printheads within print array 1044, may be offset, or interleaved, in the cross process direction 1048 from the upstream printheads, such as the printheads within print array 1032, by an integral number plus zero to one-half of the inkjet spacing on a printhead. Thus, the serially arranged printheads enable one or more rows, depending upon the number of inkjet rows in the printheads, to be printed with a spacing that is twice the spacing of each single printhead individually. For example, two 300 dpi printheads offset in the cross process direction 1048 by a distance of one-half of an inkjet width enable rows of 600 dpi to be printed, though the printheads need not be aligned to an integral number plus one-half of the inkjet spacing either by intention or by misalignment. The print bars and print arrays of each color unit 1012, 1016, 1020, and 1024 are arranged in this same manner. Thus, the serially arranged and interleaved printhead arrays enable drop-on-drop printing of different primary colors to produce secondary colors.

Referring again to FIG. 3, after drops of ink are ejected onto the moving web 20 within the print zone 18 to form an image, the web 20 continues along the media path so that the image passes through a fixing assembly 50, which fixes the ink drops to the web 20. In the embodiment shown, the fixing assembly 50 comprises at least one pair of fixing rollers 54 that are positioned in relation to each other to form a nip through which the media web 20 is fed. The ink drops on the media web 20 are pressed into and spread out on the web 20 by the pressure formed by the nip. Although the fixing assembly 50 is depicted as a pair of fixing rollers 54, the fixing assembly may be any suitable type of device or apparatus, as is known in the art, which is capable of fixing, drying, or curing an ink image onto the media.

With reference to the print zone shown in FIG. 5, the printheads associated with each print array are operated by a printhead controller with reference to a set of printhead parameters stored in the printhead controller. One of these parameters is a firing signal waveform parameter. This parameter can be altered to configure the inkjets of each printhead in a print array to eject ink drops of a predetermined size. Thus, individual printheads can be configured to eject ink drops of different sizes, but no previously known systems operated the printheads in one array of a color unit to eject ink drops of one size, while the printheads of the other array within the color unit were configured to eject ink drops of a different size. The system and method disclosed in this document configures the printheads within a color unit in this manner and allocates the color separation data to the different arrays within the color unit that ejects ink for the color separation as described below.

A block diagram of a system that selectively ejects ink drops of specified sizes from the printheads of a printhead array in a group of serially arranged and interleaved printhead arrays for a color unit is shown in FIG. 1. In one embodiment, the printheads of one array can be manufactured to eject ink drops having a first size and the printheads of the other array in the color unit can manufactured to eject ink drops having a second size that is larger than the first size. That is, the size of the ink drops ejected by the printheads in an array cannot be dynamically altered. In another embodiment, the printheads are manufactured to eject ink drops of the same size, but the printheads can be operated with different firing signal parameters to enable the printheads of the different arrays to eject different size ink drops. While these printheads can by dynamically altered, they are not changed in the system and method described in this document for any individual document or group of documents, referred to in this document as a job, to avoid the loss in timing efficiency previously described.

The system 200 includes an image receiver 204 that receives a color separation from an image source. The input image values of the color separation stored in the receiver 204 are processed by a print engine processor 208 to generate output image values and timing signals that are used by printhead controller 218 to generate electrical firing signals for inkjets in the first and second printhead arrays 220, 228. In the embodiment shown, the processor 208 processes the input image values of the color separation in a serial manner and generates multiple sets of output image values, one set of output values for each serially arranged printhead array. The printhead controller 218 then uses these output values to generate firing signals for each of the printhead arrays. In another embodiment, two processors may be used to independently process the input values of the color separation in parallel and generate output image values for use by the printhead controller. Referring still to FIG. 1, the first and second printhead arrays 220, 228 are independently configured to eject either large sized ink drops or small sized ink drops. In the embodiment shown, the first printhead 220 is configured to jet ink drops having a first drop mass, which in one embodiment is approximately 18.5 nanograms. In this embodiment, the first drop mass corresponds to the large sized ink drops. In this embodiment, the second printhead 228 is configured to jet ink drops having a second drop mass, which is approximately 13 nanograms. In this embodiment, the second drop mass corresponds to the small sized ink drops. Although approximate drop masses have been specified, alternative drop masses may be used for each of the serially arranged printheads. The different masses of the large and small sized ink drops are generated with firing signal waveforms generated with different parameters. For example, the printhead controller 218 in one embodiment is configured with firing signal parameters that enable the controller to generate electrical firing signals having an amplitude and timing that is different than the amplitude and timing of the firing signals generated by the printhead controller operating the printhead ejecting the smaller ink drops. The printhead controller 218 generates the firing signal waveforms with reference to firing signal parameters stored in a memory operatively connected to the printhead controller. The firing signal parameters include, for example, a peak-to-peak voltage, a frequency, and a norming voltage. In the embodiment shown, the large waveform has a first amplitude and the small waveform has a second amplitude with the second amplitude being less than the first amplitude.

Figure 2A:
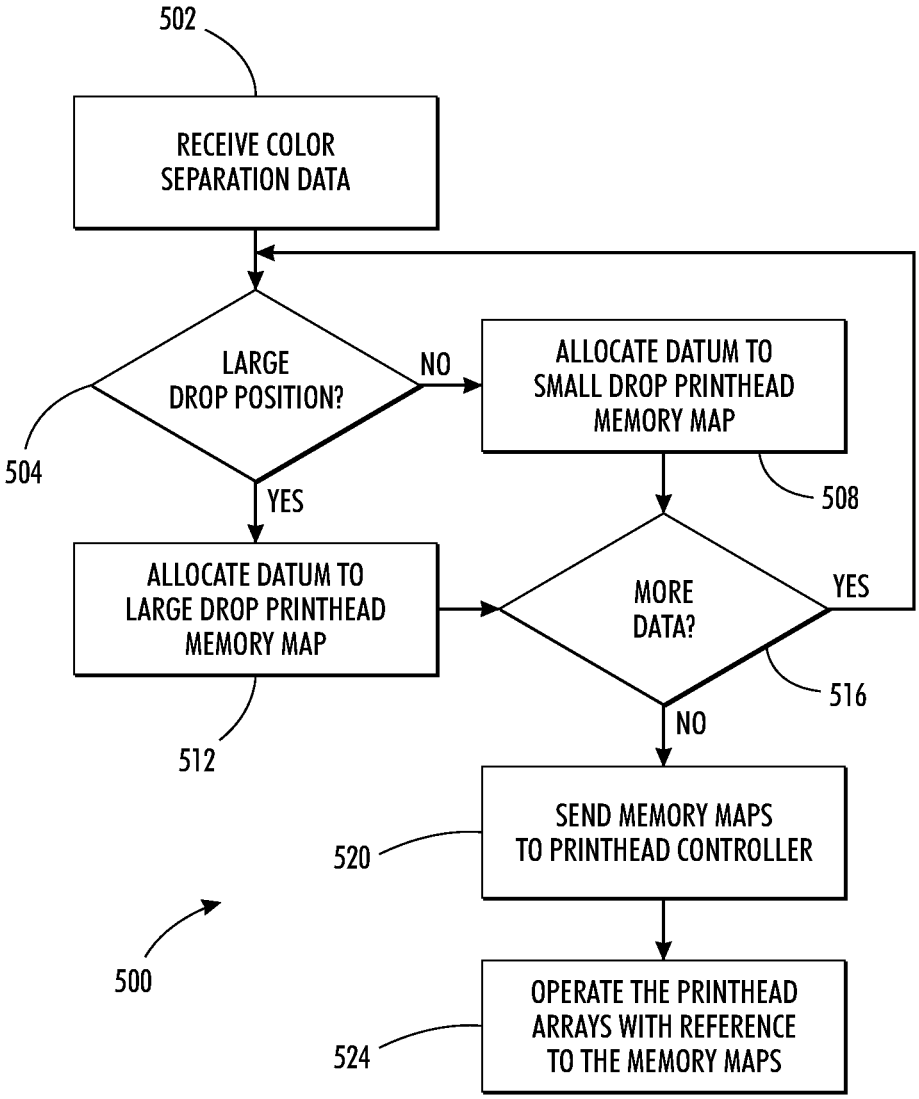
FIG. 2A is a flow diagram of a process for allocating image data with reference to data position.

A flow diagram of a process 500 for allocating the data of a color separation to one array of the two serially arranged and interleaved printhead arrays configured to eject one of either large or small sized ink drops is shown in FIG. 2A. Process 500 begins by receiving input image data for a color separation at a resolution to be printed by a color unit (block 502). Each datum, or pixel, in the color separation corresponds to an input image value for a particular location in an ink image. For the given resolution, every other pixel is to be printed by one printhead array and the remaining pixels are to be printed by the other printhead array. Therefore, the process 500 allocates each datum of the data of the color separation to a memory map for one of the printheads in one of the printhead arrays based upon the position of the pixel in the color separation data (block 504). Each datum is then stored in a memory for one of the printheads with reference to the position (blocks 508 and 512). For example, if the pixels at the odd-numbered indices in a cross-process line are to be printed by the large ink drop printhead array, then the odd-numbered indexed pixels are stored in a memory map for the large ink drop printhead array and the even-numbered indexed pixels are stored in a memory map for the small drop printhead array. After the positions for all of the data have been evaluated (block 516), the memory maps are provided to the printhead controller for the color unit (block 520) to enable operation of the printheads in the respective printhead arrays with reference to the respective memory maps and firing signal parameters for the printhead array (block 524).

Figure 2B:
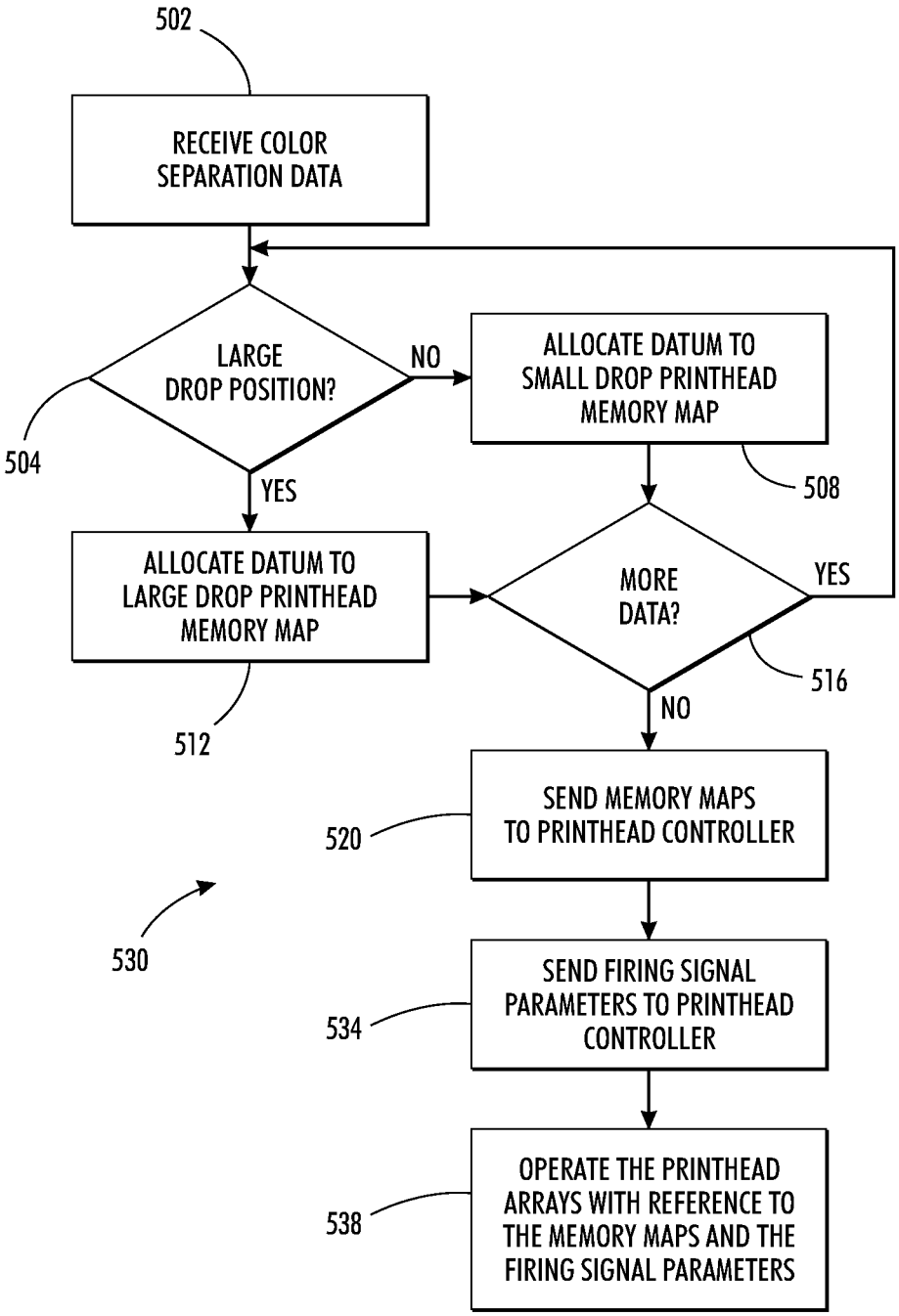
FIG. 2B is a flow diagram of a process for allocating image data with reference to data position and configuring firing signal parameters for printheads.

In another embodiment, the process 500 is modified to operate the printhead arrays at different frequencies. This process 530 is shown in FIG. 2B. After performing the processing described with reference to blocks 502 to 520, the rendering processor 520 sends firing signal parameters to the printhead controller (block 534). These firing signal parameters enable the printhead array that ejects the small ink drops to operate at a frequency in the process direction that is less than the frequency at which the large drop printhead array is operated in the process direction. The printhead arrays are then operated with reference to the memory maps and the firing signal parameters received from the rendering processor (block 538). In one embodiment of this process and system, the small drop printhead array is operated at a frequency that is one-half the frequency at which the large printhead array is operated in the process direction. Thus, the small drop printhead arrays prints every other line printed by the large drop printhead array. In one implementation of this embodiment, the small drop printhead array is operated at a frequency of 19.5 KHz and the large drop printhead array is operated at a frequency of 39 KHz.

The two printhead arrays used to print different size ink drops of a color separation are configured to eject ink drops of different masses with reference to different values for firing signal parameters stored for a printhead controller operating the printheads. For example, in one embodiment, the printhead controller has a peak-to-peak voltage parameter for one printhead array that is larger than the peak-to-peak voltage parameter for the other printhead array. In another embodiment, the firing signal frequency parameter for one printhead array is greater than the firing signal frequency parameter for the other printhead array.

Figure 2C:
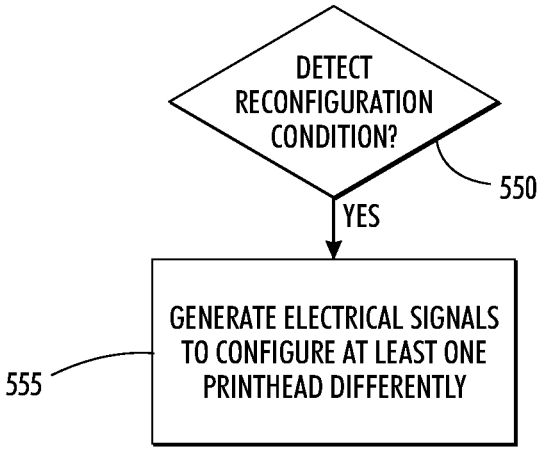
FIG. 2C is a flow diagram of a process that enables printhead configurations to be changed upon detection of a reconfiguration condition.

In another embodiment, the controller of the inkjet printer is configured to change the configuration of one or more printheads in the printer. For example, at the end of the process shown in FIG. 2A or FIG. 2B, the process of FIG. 2C can be performed. In this process, the controller determines whether a condition is detected that indicates a printhead configuration is to be changed (block 550). The condition can be, for example, an end of job, which means a single document or a group of documents identified as a job have been printed. The controller then generates electrical signals to reconfigure one of the printheads to eject ink drops having a different ink drop mass (block 555). The electrical signals can be firing signal parameters delivered to the printhead controller or some other signal that causes the inkjets in the printhead to eject ink drops having a mass that is different than the mass of the ink drops printed by the printhead during the previous job. The new ink drop mass for the printhead can be the ink drop mass printed by one of the other printheads during the previous job. For the next job, the datum are still assigned to a memory map with reference to position, but the ink drop mass ejected by the printhead corresponding to the memory map is determined by the configuration corresponding to the electrical signals generated by the controller.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of printing images in an inkjet printer comprising:

receiving image data for a color separation;

storing a portion of the color separation image data in a first memory map used to generate electrical signals for operating at least one printhead that is configured to eject ink drops of a first color and first ink drop mass;

storing a remaining portion of the color separation image data in a second memory map used to generate electrical signals for operating at least one other printhead that is configured to eject ink drops of the first color and second ink drop mass, the second ink drop mass being greater than the first ink drop mass;

generating a first plurality of electrical signals for operating the at least one printhead with reference to the first memory map for the at least one printhead;

generating a second plurality of electrical signals for operating the at least one other printhead with reference to the second memory map for the at least one other printhead;

sending an electrical signal parameter to a printhead controller that generates with reference to the electrical signal parameter the electrical signals for operating the at least one printhead and the at least one other printhead; and operating the at least one printhead with reference to the electrical signals generated by the printhead controller at a frequency in a process direction that is less than the frequency in the process direction at which the at least one other printhead is operated.

2. The method of claim 1 wherein the at least one printhead and the at least one other printhead are interleaved in a cross-process direction across the image receiving member.

3. The method of claim 2 wherein the at least one printhead and the at least one other printhead have a same resolution in the cross-process direction.

4. The method of claim 3 further comprising:

timing operation of the at least one printhead and the at least one other printhead to enable ink drops from the at least one printhead and the at least one other printhead to form a line in the cross-process direction across an image receiving member at a resolution that is twice the same resolution of the at least one printhead and the at least one other printhead.

5. The method of claim 3 further comprising:

generating the first plurality of electrical signals and the second plurality of electrical signals to operate the at least one printhead and the at least one other printhead to form a plurality of lines in the cross-process direction across an image receiving member at a resolution that is twice the same resolution of the at least one printhead and the at least one other printhead, each of the lines in the plurality of lines being separated in the process direction by a line in the cross-process direction that is formed by drops from the at least one other printhead only.

6. The method of claim 5 wherein the at least one printhead is operated at a frequency that is one-half the frequency at which the at least one other printhead is operated.

7. A method of printing images in an inkjet printer comprising:

receiving image data for a color separation;

storing a portion of the color separation image data in a first memory map used to generate electrical signals for operating at least one printhead that is configured to eject ink drops of a first color and first ink drop mass;

storing a remaining portion of the color separation image data in a second memory map used to generate electrical signals for operating at least one other printhead that is configured to eject ink drops of the first color and second ink drop mass, the second ink drop mass being greater than the first ink drop mass; generating a first plurality of electrical signals for operating the at least one printhead with reference to the first memory map for the at least one printhead;

detecting a condition for reconfiguring one of the at least one printhead and the at least one other printhead; and configuring the at least one printhead to eject ink drops having the second ink drop mass.

8. The method of claim 7 wherein the condition is detection of an end of a job.

9. A method of printing images in an inkjet printer comprising:

receiving image data for a color separation;

storing a portion of the color separation image data in a first memory map used to generate electrical signals for operating at least one printhead that is configured to eject ink drops of a first color and first ink drop mass;

storing a remaining portion of the color separation image data in a second memory map used to generate electrical signals for operating at least one other printhead that is configured to eject ink drops of the first color and second ink drop mass, the second ink drop mass being greater than the first ink drop mass; generating a first plurality of electrical signals for operating the at least one printhead with reference to the first memory map for the at least one printhead;

detecting a condition for reconfiguring one of the at least one printhead and the at least one other printhead; and configuring the at least one other printhead to eject ink drops having the first ink drop mass.

10. The method of claim 9 wherein the condition is detection of an end of a job.

11. An inkjet printer comprising:

a first printhead positioned in a print zone including a first plurality of inkjets, the first printhead being configured to eject ink drops of a first color and first ink drop mass;

a second printhead positioned in the print zone including a second plurality of inkjets, the second printhead being configured to eject ink drops of the first color and a second ink drop mass, the second ink drop mass being greater than the first ink drop mass;

a media path configured to move a print medium through the print zone in a process direction past the first printhead and the second printhead; and a controller operatively connected to the first printhead, the second printhead, and the media path, the controller being configured to:

receive image data for a color separation;

store a portion of the color separation image data in a first memory map used to generate electrical signals for operating the first printhead;

store a remaining portion of the color separation image data in a second memory map used to generate electrical signals for operating the second printhead;

generate electrical signal parameters;

generate a first plurality of electrical signals for operating the first printhead with reference to the first memory map for the first printhead; and generate a second plurality of electrical signals for operating the second printhead with reference to the second memory map for the second printhead;

a printhead controller operative connected to the first printhead and the second printhead, the printhead controller being configured to:

generate with reference to electrical signal parameters received from the controller the electrical signals for operating the first printhead and the second printhead; and operate the first printhead at a frequency in a process direction that is less than the frequency in the process direction at which the second printhead is operated with reference to the electrical signal parameters received from the controller.

12. The inkjet printer of claim 11 wherein the first printhead and the second printhead are interleaved in a cross-process direction across an image receiving member.

13. The inkjet printer of claim 12 wherein the at least one printhead and the at least one other printhead have a same resolution in the cross-process direction.

14. The inkjet printer of claim 13, the controller being further configured to:

operate the first printhead and the second printhead to enable ink drops from the first printhead and the second printhead to form a line in the cross-process direction across the image receiving member at a resolution that is twice the same resolution of the at first printhead and the second printhead.

15. The inkjet printer of claim 13, the controller being further configured to:

generate the first plurality of electrical signals and the second plurality of electrical signals to operate the at least one printhead and the at least one other printhead to form a plurality of lines in the cross-process direction across an image receiving member at a resolution that is twice the same resolution of the at least one printhead and the at least one other printhead and to separate the lines in the plurality of lines in the process direction by a line in the cross-process direction that is formed by drops from the second printhead only.

16. The inkjet printer of claim 11 wherein the printhead controller operates the first printhead at a frequency that is one-half the frequency at which the second printhead is operated.

17. The inkjet printer of claim 15, the media path being configured to move the print medium past the first printhead and the second printhead in the process direction only once to form the line at the resolution that is twice the same resolution of the first printhead and the second printhead.

18. An inkjet printer comprising:

a first printhead positioned in a print zone including a first plurality of inkjets, the first printhead being configured to eject ink drops of a first color and first ink drop mass;

a second printhead positioned in the print zone including a second plurality of inkjets, the second printhead being configured to eject ink drops of the first color and a second ink drop mass, the second ink drop mass being greater than the first ink drop mass;

a media path configured to move a print medium through the print zone in a process direction past the first printhead and the second printhead; and a controller operatively connected to the first printhead, the second printhead, and the media path, the controller being configured to:

receive image data for a color separation;

store a portion of the color separation image data in a first memory map used to generate electrical signals for operating the first printhead;

store a remaining portion of the color separation image data in a second memory map used to generate electrical signals for operating the second printhead;

generate a first plurality of electrical signals for operating the first printhead with reference to the first memory map for the first printhead;

generate a second plurality of electrical signals for operating the second printhead with reference to the second memory map for the second printhead;

detect a condition for reconfiguring one of the first printhead and the second printhead; and generate electrical signals that configure the first printhead to eject ink drops having the second ink drop mass.

19. The inkjet printer of claim 18 wherein the condition is detection of an end of a job.

20. An inkjet printer comprising:

a first printhead positioned in a print zone including a first plurality of inkjets, the first printhead being configured to eject ink drops of a first color and first ink drop mass;

a second printhead positioned in the print zone including a second plurality of inkjets, the second printhead being configured to eject ink drops of the first color and a second ink drop mass, the second ink drop mass being greater than the first ink drop mass;

a media path configured to move a print medium through the print zone in a process direction past the first printhead and the second printhead; and a controller operatively connected to the first printhead, the second printhead, and the media path, the controller being configured to:

receive image data for a color separation;

store a portion of the color separation image data in a first memory map used to generate electrical signals for operating the first printhead;

store a remaining portion of the color separation image data in a second memory map used to generate electrical signals for operating the second printhead;

generate a first plurality of electrical signals for operating the first printhead with reference to the first memory map for the first printhead;

generate a second plurality of electrical signals for operating the second printhead with reference to the second memory map for the second printhead;

detect a condition for reconfiguring one of the first printhead and the second printhead; and configure the second printhead to eject ink drops having the first ink drop mass.

21. The inkjet printer of claim 20 wherein the condition is detection of an end of a job.

* * * * *